US009650308B1

(12) United States Patent
LaBonte

(10) Patent No.: US 9,650,308 B1
(45) Date of Patent: May 16, 2017

(54) REDUCED TOXICITY SCREENING SMOKE PRODUCING COMPOSITION USING LITHIUM PERCHLORATE

(71) Applicant: U.S. Army Edgewood Chemical and Biological Command, Washington, DC (US)

(72) Inventor: Amee W LaBonte, Havre de Grace, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 288 days.

(21) Appl. No.: 14/645,644

(22) Filed: Mar. 12, 2015

(51) Int. Cl.

| | |
|---|---|
| ***C06B 43/00*** | (2006.01) |
| ***C06B 33/00*** | (2006.01) |
| ***C06B 29/00*** | (2006.01) |
| ***C06B 29/02*** | (2006.01) |
| ***C06B 29/14*** | (2006.01) |
| ***D03D 23/00*** | (2006.01) |
| ***D03D 43/00*** | (2006.01) |
| ***C06B 23/00*** | (2006.01) |
| ***C06B 23/04*** | (2006.01) |
| ***C06B 29/04*** | (2006.01) |
| ***F42B 33/00*** | (2006.01) |

(52) U.S. Cl.
CPC ..... *C06B 29/02* (2013.01); *C06B 23/007* (2013.01); *C06B 23/04* (2013.01); *C06B 29/04* (2013.01); *F42B 33/001* (2013.01)

(58) Field of Classification Search
USPC ..... 149/75, 22, 37, 77, 81, 109.2, 109.4, 149/109.6
See application file for complete search history.

(56) References Cited

U.S. PATENT DOCUMENTS 3,475,237 A * 10/1969 Lane ..... C06B 33/00 149/117
3,513,043 A * 5/1970 Burnside ..... F42B 15/34 149/19.3

* cited by examiner

*Primary Examiner* — James McDonough
(74) *Attorney, Agent, or Firm* — Ulysses John Biffoni

(57) ABSTRACT

A reduced toxicity baseline screening smoke composition and method includes a mixture of lithium perchlorate and boron. The mixture may further include a burn rate modifier and any of an inorganic chloride coolant and a carbonate coolant. The lithium perchlorate may be in the range of 75% to 95% parts by weight. The boron may be in the range of 5% to 25% parts by weight. The any of an inorganic chloride coolant and a carbonate coolant may be in the range of 5% to 25% parts by weight. The mixture may include boron oxide.

17 Claims, 1 Drawing Sheet

REDUCED TOXICITY SCREENING SMOKE PRODUCING COMPOSITION USING LITHIUM PERCHLORATE

GOVERNMENT INTEREST

The embodiments described herein may be manufactured, used, and/or licensed by or for the United States Government.

BACKGROUND

Technical Field

The embodiments herein generally relate to a screening smoke composition, and more particularly to a screening smoke composition of reduced toxicity.

Description of the Related Art

The most common screening smoke composition, known as HC, is a blend of zinc or zinc oxide powder, aluminum, and hexachloroethane. It is generally an effective smoke producing composition based on the production of toxic zinc chloride. In one particular formulation, the aluminum reacts with the zinc oxide to form zinc metal which, in turn, reacts with the chlorine atoms in the hexachloroethane to form zinc chloride. The exiting zinc chloride captures water from the atmosphere, which greatly increases the amount of apparent smoke produced by a given weight of the starting weight of the smoke composition. This water capturing ability is the characteristic of the composition to be most effective.

SUMMARY

In view of the foregoing, an embodiment herein provides a reduced toxicity baseline screening smoke composition comprising a mixture of lithium perchlorate and boron. The mixture may further comprise a burn rate modifier and any of an inorganic chloride coolant and a carbonate coolant. The lithium perchlorate may be in the range of 75% to 95% parts by weight. The boron may be in the range of 5% to 25% parts by weight. The any of an inorganic chloride coolant and a carbonate coolant may be in the range of 5% to 25% parts by weight. The mixture may include boron oxide.

Another embodiment provides a method of consolidating a reduced toxicity baseline screening smoke composition, the method comprising creating a mixture of lithium perchlorate and boron. The method may further comprise mixing a burn rate modifier and any of an inorganic chloride coolant and a carbonate coolant in the mixture. The lithium perchlorate may be in the range of 75% to 95% parts by weight. The boron may be in the range of 5% to 25% parts by weight. The any of an inorganic chloride coolant and a carbonate coolant may be in the range of 5% to 25% parts by weight. The method may further comprise mixing boron oxide in the mixture. The method may further comprise inserting the mixture at loading pressures between 2,500 and 5,000 pounds per square inch into a canister. The method may further comprise inserting the mixture at loading pressures between 5,000 and 7,500 pounds per square inch into a canister. The method may further comprise inserting the composition into any of a canister of a grenade, a smoke pot, a mortar round, a shoulder fired missile, and an artillery round.

Another embodiment provides a method of consolidating a reduced toxicity baseline screening smoke composition, the method comprising creating a mixture comprising lithium perchlorate in the range of 75% to 95% parts by weight and boron in the range of 5% to 25% parts by weight. The method may further comprise mixing in the mixture a burn rate modifier and any of an inorganic chloride coolant and a carbonate coolant in the range of 5% to 25% parts by weight in the, mixture. The method may further comprise mixing boron oxide in the mixture. The method may further comprise inserting the mixture at loading pressures between 2,500 and 5,000 pounds per square inch into a canister. The method may further comprise inserting the mixture at loading pressures between 5,000 and 7,500 pounds per square inch into a canister.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Figure 1:
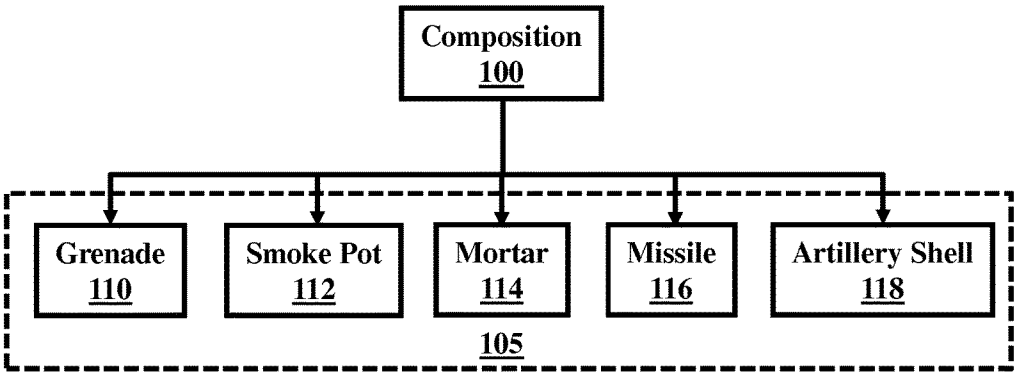
FIG. 1 is a block diagram of using the reduced toxicity smoke composition according to an embodiment herein.
Figure 2:
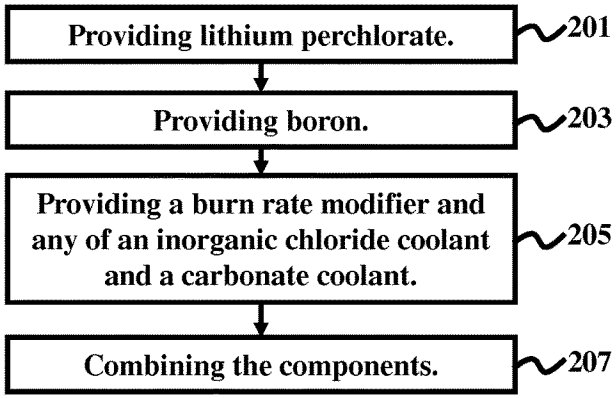
FIG. 2 is a flow diagram illustrating a method according to an embodiment herein.

Referring now to the drawings, and more particularly to FIGS. 1 and 2, there are shown preferred embodiments, which comprise a new screening smoke composition 100 of reduced toxicity that is produced without the use of organic liquids which add to air pollution, and contain specific chemicals to increase its long term shelf life. The screening smoke composition 100 comprises a mixture of lithium perchlorate and boron. The mixture utilizes lithium perchlorate as the oxidizer and chlorine donor, and produces a two smoke cloud devoid of zinc chloride. The use of boron as the fuel results in the production of lithium chloride, an effective compound during the water absorption phase of the burning reaction. The composition 100 produces boron oxide ($B_2O_3$) and lithium chloride (LiCl). A virtually undetectable amount of boron trichloride ($BCl_3$) and chlorine gas may be byproducts of the composition 100. The chemical reaction for the production of the smoke cloud comprises a two reactant/two product system. The boron powder reacts immediately with the oxygen in the lithium perchlorate, producing a combination of boron oxide and of lithium chloride.

The ratios of the components a the composition 100 can be varied in such a manner as to adjust the overall rate of the chemical reaction, which is represented by the burning rate for a pressed block of smoke producing composition. Additional coolants may be added to the composition 100 to affect its burning rate as well as provide an additional quantity of smoke by using the heat drawn from the main chemical reactions to vaporize and recondense the coolant materials. Coolants such as lithium carbonate can add further to the smoke cloud density.

The embodiments herein provide a reduced toxicity screening smoke composition 100 using lithium perchlorate and boron. The composition 100 is completely devoid of the toxic zinc chloride found in conventional smoke formulations containing primarily zinc and/or zinc oxide as the main constituent for the production of a toxic zinc chloride smoke cloud. The smoke composition 100 is suitable for pressing into canisters 105 of compacted powder at a load pressure range of 2,500 to 7,500 psi.

FIG. 1 is a block diagram illustrating utilizing the reduced toxicity smoke composition 100 in canisters 105, which can be implemented in flares 108, hand grenades 110, smoke pots 112, mortars 114, shoulder fired missiles 116, and artillery shells 118. The reduced toxicity screening smoke composition 100 has an application in any pressed configuration. When pressed at a leading pressure of 3,500 pounds per square inch into a suitable sized canister 105, the base composition 100 can provide a dense grayish-white smoke cloud between 30 and 90 seconds. The total burn time for the hand grenade sized item can be increased beyond 120 seconds by adding additional amounts of a coolant such as the carbonates or chlorides of suitable salts; i.e., ammonium, calcium, sodium, magnesium, and/or lithium.

When pressed into larger canisters 105 suitable for use in a mortar 114 or artillery shell 118, the composition 100 is pressed at a suitable loading pressure that exceeds the setback force on the canister 105 during the flight to the target area. The base composition 100 produces large quantities of smoke when pressed to pressures of 5,000 psi.

FIG. 2, with reference to FIG. 1, is a flow diagram illustrating a method of consolidating a reduced toxicity baseline screening smoke composition 100. The method comprises creating a mixture by combining various components including providing (201) lithium perchlorate, providing (203) boron, providing (205) a burn rate modifier and any of an inorganic chloride coolant and a carbonate coolant, and combining (207) the components to create the composition 100. The lithium perchlorate is in the range of 75% to 95% parts by weight. The boron is in the range of 5% to 25% parts by weight. The burn rate modifier and the any of an inorganic chloride coolant and the carbonate coolant is in the range of 5% to 25% parts by weight. The method may further comprise mixing boron oxide in the mixture. In this regard, the composition 100 preferably includes boron oxides versus toxic boron chlorides. The method may further comprise creating the mixture at loading pressures between 2,500 and 5,000 pounds per square inch into a canister 105. In another embodiment, the method may further comprise creating the mixture at loading, pressures between 5,000 and 7,500 pounds per square inch into a canister 105. The method may further comprise consolidating the composition into any of a canister of a grenade 110 (e.g., approximately 2.3 inches in diameter and between 4.5 and 6.0 inches in height), a smoke pot 112 (e.g., ranging from approximately 6 inches in diameter and nominally 8 inches in height to approximately 12 inches in diameter and nominally 13 inches in height), a mortar round 114, a shoulder fired missile 116, and an artillery round 118.

The screening smoke producing composition 100 may be consolidated at loading pressures between 2,500 and 5,000 pounds per square inch into a canister 105 of smoke grenade size totaling approximately 2.3 inches in diameter and between approximately 4.5 and 6.0 inches in height. Additionally, the screening smoke producing composition 100 may be consolidated at loading pressures between 2,500 and 5,000 pounds per square inch into a canister 105 of smoke pot size ranging from approximately 6.0 inches in diameter and nominally approximately 8.0 inches in height to approximately 12.0 inches in diameter and nominally approximately 13.0 inches in height. Furthermore, the screening smoke producing composition 100 may be consolidated at loading pressures between 2,500 and 5,000 pounds per square inch into a single or multiple canisters 105 totaling approximately 2.75 inches in diameter and between approximately 7.5 and 9.0 inches in height for use in an 81 mm or similar mortar payload configuration. Moreover, the screening smoke producing composition 100 may be consolidated at loading pressures between 5,000 and 7,500 pounds per square inch into a single or multiple canisters 105 of smoke artillery size totaling approximately 5.0 inches in diameter and nominally approximately 21.0 inches in height for use in a 155 mm projectile.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A reduced toxicity baseline screening smoke composition comprising a mixture of lithium perchlorate, boron, a burn rate modifier and any of an inorganic chloride coolant and a carbonate coolant.

2. The composition of claim 1, wherein said lithium perchlorate is in the range of 75% to 95% parts by weight.

3. The composition of claim 1, wherein said boron is in the range of 5% to 25% parts by weight.

4. The composition of claim 1, wherein said any of an inorganic chloride coolant and a carbonate coolant is in the range of 5% to 25% parts by weight.

5. The composition of claim 1, wherein said mixture includes boron oxide.

6. A method of consolidating a reduced toxicity baseline screening smoke composition, said method comprising creating a mixture of lithium perchlorate, boron, a burn rate modifier and any of an inorganic chloride coolant and a carbonate coolant.

7. The method of claim 6, wherein said lithium perchlorate is in the range of 75% to 95% parts by weight.

8. The method of claim 6, wherein said boron is in the range of 5% to 25% parts by weight.

9. The method of claim 6, wherein said any of an inorganic chloride coolant and a carbonate coolant is in the range of 5% to 25% parts by weight.

10. The method of claim 6, further comprising mixing boron oxide in said mixture.

11. The method of claim 6, further comprising inserting said mixture at loading pressures between 2,500 and 5,000 pounds per square inch into a canister.

12. The method of claim 6, further comprising inserting said mixture at loading pressures between 5,000 and 7,500 pounds per square inch into a canister.

13. The method of claim 6, further comprising inserting said composition into any of a canister of a grenade, a smoke pot, a mortar round, a shoulder fired missile, and an artillery round.

14. A method of consolidating a reduced toxicity baseline screening smoke composition, said method comprising creating a mixture comprising lithium perchlorate in the range of 75% to 95% parts by weight, boron in the range of 5% to 25% parts by weight, and a burn rate modifier and any of an inorganic chloride coolant and a carbonate coolant in the range of 5% to 25% parts by weight in said mixture.

15. The method of claim 14, further comprising mixing boron oxide in said mixture.

16. The method of claim 14, further comprising inserting said mixture at loading pressures between 2,500 and 5,000 pounds per square inch into a canister.

17. The method of claim 14, further comprising inserting said mixture at loading pressures between 5,000 and 7,500 pounds per square inch into a canister.

* * * * *